United States Patent [19]

Larsson

[11] Patent Number: 4,732,208

[45] Date of Patent: Mar. 22, 1988

[54] METHOD AND APPLICATION FOR HORIZONTAL CONTINUOUS CASTING

[75] Inventor: Hans-Gunnar Larsson, Västerås, Sweden

[73] Assignee: ASEA AB, Västerås, Sweden

[21] Appl. No.: 932,031

[22] Filed: Nov. 18, 1986

[30] Foreign Application Priority Data

Nov. 21, 1985 [SE] Sweden ..... 8505505

[51] Int. Cl.[4] ..... B22D 11/00; B22D 27/02

[52] U.S. Cl. ..... 164/468; 164/490

[58] Field of Search ..... 164/468, 504, 440, 490

[56] References Cited

U.S. PATENT DOCUMENTS 4,527,615 7/1985 Narita et al. ..... 164/504 X

FOREIGN PATENT DOCUMENTS 2423284 12/1979 France ..... 164/504

58-70946 4/1983 Japan ..... 164/504

*Primary Examiner*—Kuang Y. Lin

*Attorney, Agent, or Firm*—Kenyon & Kenyon

[57] ABSTRACT

In horizontal continuous casting, the casting proceeds step-by-step with the forming strand being intermittently pulled from the mold. The strand forms with a skin with a melt inside of the skin and this melt is stirred by a magnetic stirrer on the outside of the mold. This forms a thin wall in the skin at that location, forming a breaking location or point where the skin pulls apart each time the strand is pulled forwardly. The mold is continuously fed with melt and the skin's strand reforms or welds together at the strand break.

3 Claims, 11 Drawing Figures

METHOD AND APPLICATION FOR HORIZONTAL CONTINUOUS CASTING

This invention relates to horizontal continuous casting, in which a horizontal continuous casting mold is used. The mold is normally made of cooper and is water cooled.

Casting proceeds by a succession of steps each comprising filling the mold with a melt and allowing time for the mold to form in it a length of strand comprising a solidified skin containing melt. At the start, a dummy may be used. After the skin is formed with the melt stationary in the mold, the length of strand is pulled forwardly partially from the mold while flowing additional melt into the mold so as to form a following length of strand having its skin welded to the trailing end of the skin of the first length. The steps are successively repeated while flowing additional melt into the mold so as to form by each step following lengths of strand each having its skin welded to the trailing ends to the skins of a proceeding length until step-by-step a desired length of casting is obtained.

The melt is introduced to the mold through a break-ring positioned concentrically in front of the mold and having a surface to which the melt does not weld to a degree preventing the strand from being pulled forwardly for each step. The break-ring is normally made of boron nitride and/or silicon nitride which are relatively soft materials and subject to rapid wear so that undesirably frequent replacement of the breaking is usual. When the strand is pulled forwardly its skin breaks away from the breaking causing it to wear.

The melt is supplied to the mold through the break-ring from a melt container such as a ladle having a horizontal discharge opening in its side wall at the bottom. When the trailing end of a length is pulled from the break-ring, oxygen entrapped by the melt trends to oxidize the melt at the break ring, which interferes with proper welding of the strand skill lengths end-to-end.

An object of the present invention is to improve on the above particularly by reducing the wear on the break ring and producing better welds between the lengths of strand skins.

As a brief summary of the invention, at each step the melt introduced to the mold after a proceeding strand length is partially pulled from the mold, is inductively stirred longitudinally at a location about midway in the mold and between the ends of the strand. This stirring thins the strand skin at that location and forms a new breaking point when the strand is pulled, this point being relatively remote from the breaking. To get to this point, oxygen must travel from the break ring to the new breaking point, where its oxidizing effect has largely been dissipated. At each new strand skin is formed, each becomes welded to the proceeding strand's skin. Welding takes place in the stirred melt so that better welds are obtained.

The invention is explained in more detail by the following which refers to the accompanying drawings, in which:

FIG. 1 is vertical section schematically showing a prior art horizontal continuous casting apparatus.

FIG. 2 on an enlarged scale is a vertical section schematically showing the appearance of the welds in the case of the prior art practice.

Figure 1:
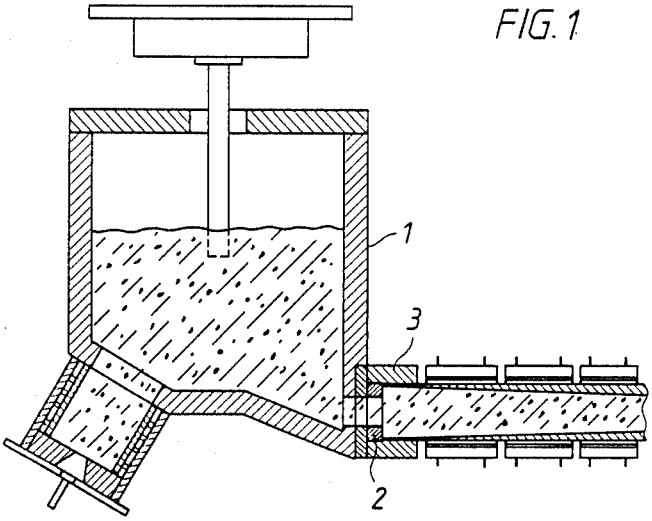

In these drawings, FIG. 1 shows a ladle containing a melt such as steel and feeding the melt horizontally through a break ring 2 into a horizontal continuous casting mold 3.

Figure 2:
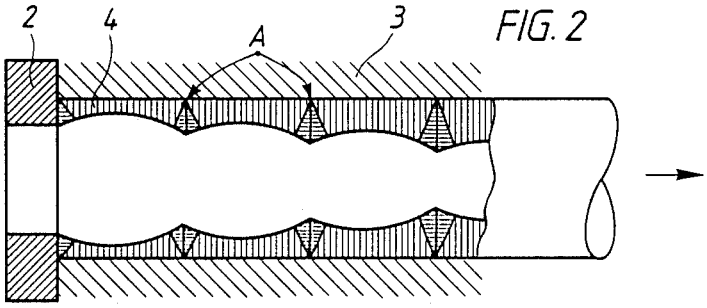

With the melt stationary in the mold, the skin solidifies after the break ring 2, and then after a short forward movement a new melt runs down behind so that welds occurs between the skin ends during the casting process. If the welds are imperfect because of oxidation the formation of cracks may appear in the ultimate casting. The general appearance of the welds A is shown in FIG. 2 schematically. It is to be understood that the strand ultimately solidified throughout after leaving the mold.

Figure 3:
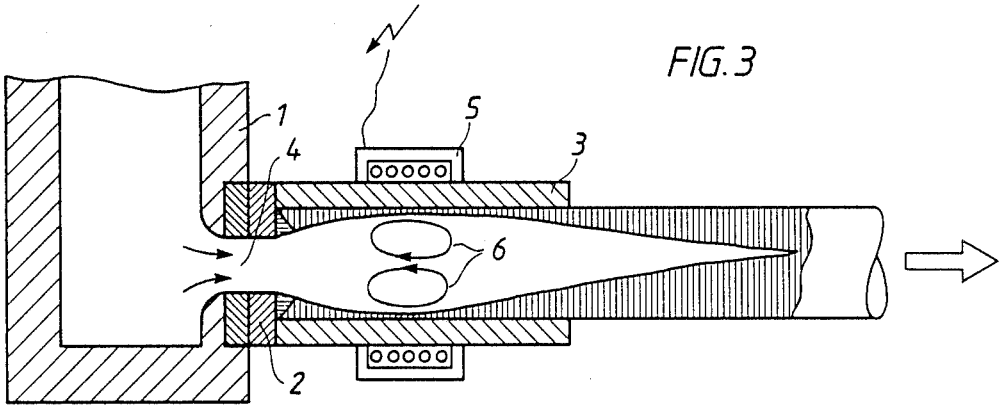
FIG. 3 is a vertical section schematically showing the invention.

The invention is illustrated by FIG. 3 where the melt is shown flowing through the ladles side wall opening 4 through the break ring 2 into the continuous casting mold 3. An electromagnetic stirrer 5 surrounds the mold 3 between its opposite ends, preferably at about the middle of the mold. This stirrer can be of the same kind that is used to stir the melt in the strand leaving a mold during vertical continuous casting. Such strirrers are well known by the prior art.

In FIG. 3 the mold is cylindrical and a round billet B is being cast step-by-step. During the casting, the melt is inductively stirred in the longitudinal direction of the mold as indicated by the arrows 6. The stirrer can be cylindrical as to encircle the mold.

Figure 4:
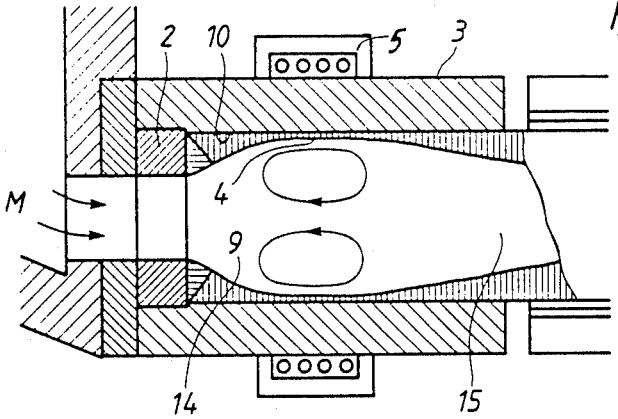
FIGS. 4–5 are vertical sections showing the thinning of a strand length and its breaking at the thinned portion of the strand's skin.
Figure 5:
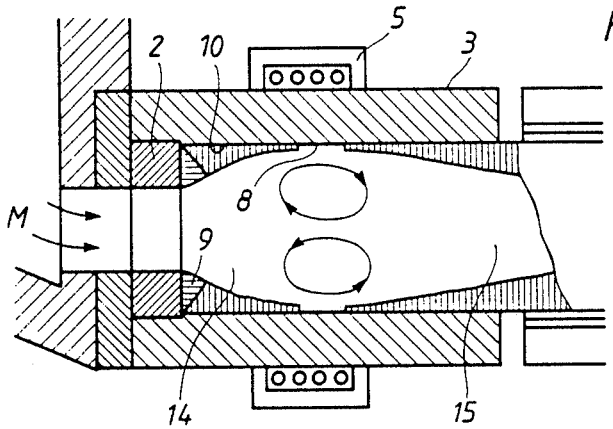

The casting sequence is shown by FIG. 4 and 5. FIG. 4 shows the appearance just prior to a withdrawal stroke of the strand and FIG. 5 shows the appearance immediately afterwards. It can be seen that the strokes are relatively short as compared to the length of the mold. The thinned portion in FIG. 4 has been pulled apart or broken at 8 in FIG. 5. The portion 9 at the break ring remains unchanged at all times. A more uniform structure of the skin is obtained. The tips in the inner surface shown at A in FIG. 2 are largely eliminated. During the stop period at the end of each of the withdrawal strokes, the incoming melt indicated by the arrows M keeps the mold filled at the times the melt welds the ends of the skins together as shown at 7 in FIG. 4. All the time the inductive stirring by the stirrer 5 is maintained. As previously mentioned, a dummy (not shown) is inserted in the back end of the mold until a skin is obtained permitting the strand to be pulled intermittently from the mold, when the casting operation is first started.

At each forward stroke of the strand, its skin breaks at the thinned portion 7 and not of the break ring 2, so the life of the break ring is prolonged. Oxygen from the melt possibly collected at the break ring must travel a considerable distance to get to a point where the strand breaks and where, as in FIG. 4, the ends of the pulled strand skin must weld together. The oxidizing effect is greatly reduced.

To more positively retain the skin that remains in the mold next to the break ring 1, a circular rib 10 may be fixed or cast on the inside of the mold at a position spaced between the location 8 of the new breaking point of the strand's skin and the breaking.

Figure 6:
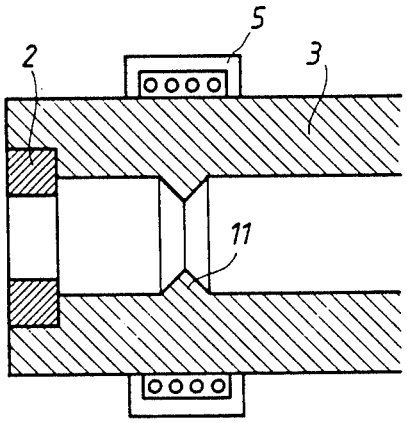
FIG. 6 is a vertical section showing a modification of the invention.
Figure 6A:
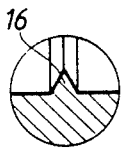
Figure 6B:
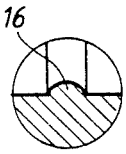
Figure 6C:
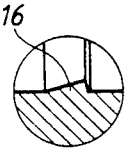

In the modification shown by FIG. 6, a relatively larger circular projection 11 is formed in the mold's inner surface at a position directly opposite the stirrer 5. Such a projection increases the flow of the melt over the edge of the projection and provides a more clear definition of the breakage point of the strand's skin. This permits the melt in the ladle to have a higher temperature than can ordinarily be accepted. It is desireable to maintain the melt at a higher temperature to avoid any risk of its solidification prematurely at the break ring 2. For contrast, the smaller rib 10 is shown in FIG. 6 in various modifications illustrated in FIG. 6(*a*), FIG. 6(*b*) and FIG. 6(*c*).

Figure 7:
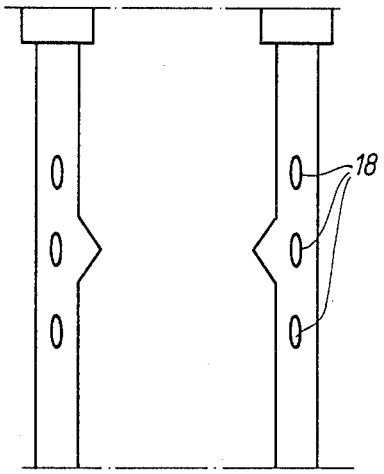
FIG. 7 illustrates an additional design comprising cooling channels.
Figure 8:
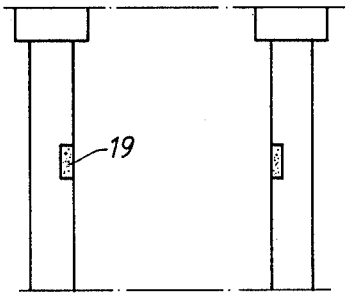
FIG. 8 shows an alternative design comprising a ring or annular member consisting of a material having a low thermal conductivity.

FIG. 7 illustrates an alternative embodiment of the apparatus and method of the present invention comprising cooling channel 18. FIG. 8 illustrates a further variation of the present invention comprising a ring or annular member 19 comprised of a material having a low thermal conductivity.

I claim:

1. A method for horizontal continuous casting comprising a succession of steps each comprising filling a horizontal continuous casting mold with a melt and allowing time for the mold to form in it a length of strand having a solid skin containing melt, and thereafter pulling the length forwardly partially from the mold while flowing additional melt into the mold so as to form a following length of said strand having its skin welded to the trailing end of the skin of the first length, and successively repeating said steps and forming additional lengths until step-by-step a desired length of casting is obtained; wherein the improvement comprises step of inductively stirring the melt longitudinally in the mold at a location between the ends of the mold so that the skin thins at that location and breaks apart during the pulling of the lengths of strand from the mold.

2. The method of claim 1 in which said stirring if effected by an electromagnetic stirrer on the outside of the mold between the ends of the mold.

3. The method of claim 2 in which each strand length in front of said location is releasably restrained against forward movement during said pulling by means of projection means in said mold.

* * * * *